United States Patent [19]

Smith et al.

[11] Patent Number: 4,462,584

[45] Date of Patent: Jul. 31, 1984

[54] CLAMP DEVICE FOR CLOTH SPREADING MACHINE SWITCH ACTUATOR

[75] Inventors: Hoyt L. Smith; D. Frank Farrar, Jr., both of Nashville, Tenn.

[73] Assignee: Cutters Exchange, Inc., Nashville, Tenn.

[21] Appl. No.: 418,847

[22] Filed: Sep. 16, 1982

[51] Int. Cl.[3] ..... B65H 29/46

[52] U.S. Cl. ..... 270/31; 200/61.44

[58] Field of Search ..... 270/30–31; 200/52 R, 61.44, 61.54

[56] References Cited

U.S. PATENT DOCUMENTS

| | | | |
|---|---|---|---|
| 3,400,927 | 9/1968 | Martin, Sr. et al. | 270/31 |
| 3,811,669 | 5/1974 | Benson et al. | 270/31 |
| 4,082,258 | 4/1978 | Smith | 270/31 |

FOREIGN PATENT DOCUMENTS

| | | | |
|---|---|---|---|
| 2339161 | 3/1974 | Fed. Rep. of Germany | 270/31 |
| 3019505 | 12/1981 | Fed. Rep. of Germany | 270/31 |
| 2159047 | 6/1973 | France | 270/30 |

*Primary Examiner*—E. H. Eickholt

*Attorney, Agent, or Firm*—Harrington A. Lackey

[57] ABSTRACT

A portable clamp device for releasable mounting upon the track of a cutting table supporting a longitudinally reciprocal cloth spreading machine having a position-control switch and switch actuator, the clamp device being longitudinally aligned with the switch actuator for cooperation therewith. The clamp device includes a body member having a switch actuator element for engagement by the switch actuator, and a fixed jaw and a lever-actuated movable cleat opposing the jaw, adapted to straddle the track for releasable clamping of the track in any desired operative position along the cutting table.

8 Claims, 7 Drawing Figures

CLAMP DEVICE FOR CLOTH SPREADING MACHINE SWITCH ACTUATOR

BACKGROUND OF THE INVENTION

This invention relates to cloth spreading machines, and more particularly to a portable clamp device for selective mounting in any predetermined position upon the cutting table in the path of a switch actuator element on a cloth spreading machine moving over the cutting table.

Heretofore, in cloth spreading operations, one type of cloth spreading machine is provided with a plunger-actuated switch, and more particularly a plunger-actuated reversing switch. A stop plate or stop device is semi-permanently secured by bolts or C-clamps along the side of the cutting table over which the cloth spreading machine travels, in a predetermined position, where reversal of movement of the cloth spreading machine is desired. In a cloth spreading operation in which a catcher mechanism is mounted at the end of the reciprocal course of the cloth spreading machine for folding the cloth as the machine is reversed, the stop device is fixed in a position on the cutting table adjacent the catcher mechanism.

Examples of such prior stop devices are disclosed in the prior U.S. Pat. Nos. 4,082,258 of Hoyt L. Smith Re27,538 of Thomas W. Martin et al, and 3,400,927 of Thomas W. Martin, Sr., et al.

Occasionally, it is desirable to change the length of the course over which the cloth spreading machine travels in order to vary the length of the spread layers of cloth. In such instances, the stop device must be disassembled from the cutting table by unbolting the stop device, removing it, and relocating the stop device in the new reversing position. Such an operation is time-consuming.

SUMMARY OF THE INVENTION

It is therefore one object of this invention to provide in a cloth spreading operation, in which a cloth spreading machine having a position-control switch, such as a plunger-actuated reversing switch, is utilized, a clamp device which is capable of being quickly mounted in, and just as quickly released from, a clamped operative position on the cutting table, and more specifically upon the wheel-supporting track along the cutting table.

The clamp device made in accordance with this invention, includes a body member supporting a switch actuator element, such as a transverse stop plate adapted to be engaged by the switch plunger of a cloth spreading machine, when the clamp device is mounted in its operative position. The body member of the clamp device includes an elongated transverse fixed jaw member adapted to be positioned along the inside of the existing wheel track on the cutting table. A cleat member is pivotally mounted on the body member for movement toward and away from the outside surface or face of the track, that is on the opposite side from the fixed jaw member, so that when the cleat member is moved toward the track, the track will be sandwiched or clamped between the cleat member and the fixed jaw member.

The pivotally mounted cleat member is actuated by a lever pivotally connected to the cleat member and also pivotally connected to one end of a locking bar, the opposite end of which is pivotally mounted to the body member. The arrangement of the pivotal connections is such that as the lever is forced toward the body member, the cleat member is pivoted toward its locking or clamping position, while the locking bar is simultaneously moved toward the body member until the pivotal connections have moved past dead center. Thus, the cleat member is firmly locked in clamping position against the track, and cannot be unlocked until the lever member is manually moved away from the body member.

The clamp device is also provided with adjustment means for securing the clamp device upon various size tracks.

By merely moving the lever member between its operative and inoperative positions, the clamp device may be quickly released from its clamped position upon a track, moved to another position, and just as quick re-clamped and re-locked in another clamped, operative position along the track, with a minimum of time and effort.

The clamp device made in accordance with this invention may incorporate other types of switch actuator elements than a stop plate, to cooperate with other types of position-control switches utilized on a cloth spreading machine. The switch actuator element could be a cam element for engagement by a trip arm or switch finger connected to a position-control switch, such as a change-speed switch, reversing switch or stop switch, carried by the moving cloth spreading machine. The switch actuator element carried by the body of the clamp device could be a magnet for actuating a proximity-type position-control switch, or a reflective surface for reflecting light rays to a photo-electrically actuated control switch or other energy-ray actuated switch.

DESCRIPTION OF THE PREFERRED EMBODIMENTS

Figures 1, 2, 3, 4, 5, 6, 7:
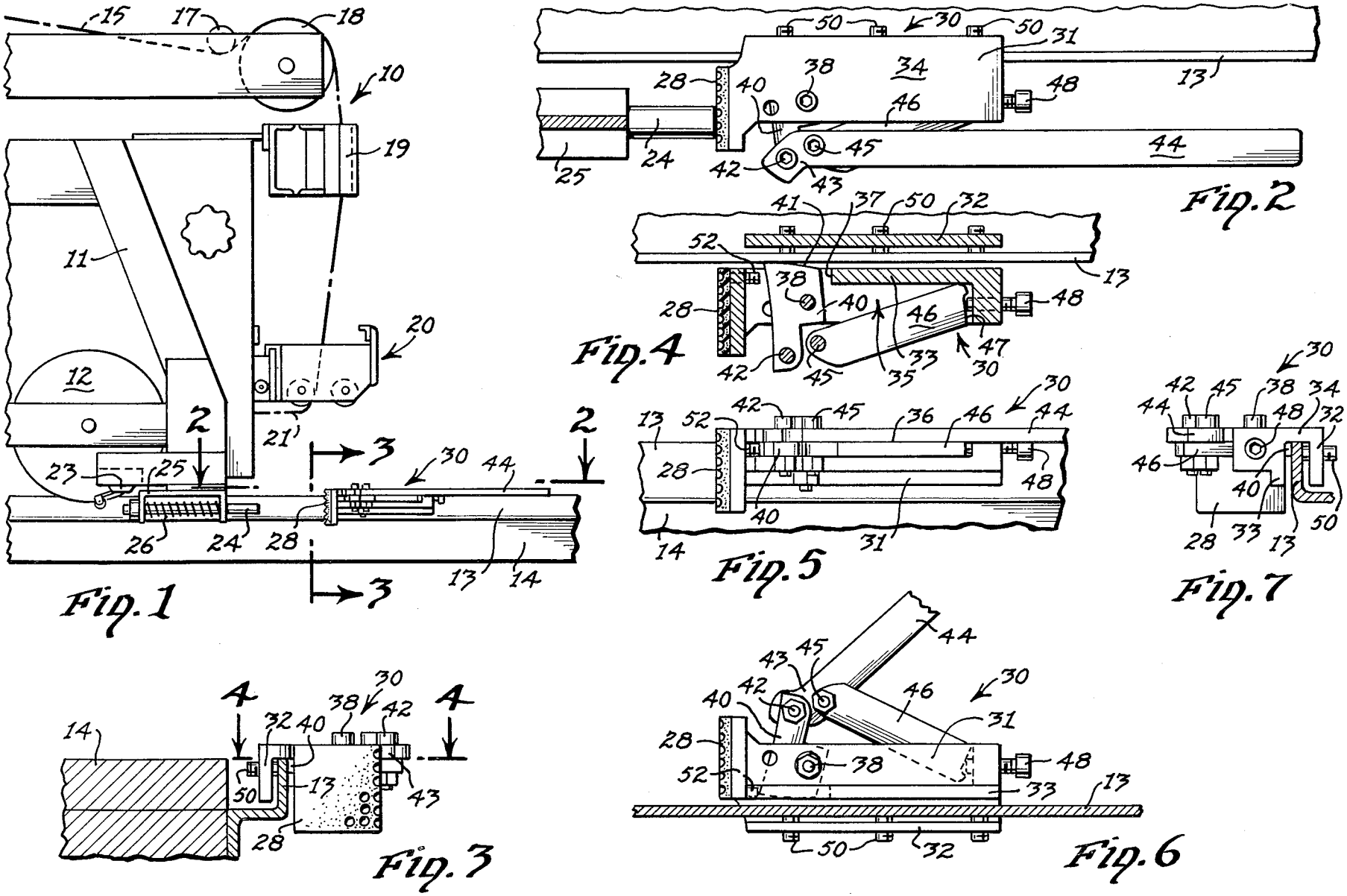
FIG. 1 is a fragmentary side elevational view of one end portion of a cloth spreading machine having a plunger-actuated reversing switch, in a position preparatory to engaging a clamp device, made in accordance with this invention, mounted in operative position upon the track of the cutting table over which the cloth spreading machine is adapted to move.
FIG. 2 is an enlarged, fragmentary, top plan view, taken along the line 2—2 of FIG. 1, illustrating the switch plunger engaging the stop member of the clamp device.
FIG. 3 is an enlarged fragmentary section, taken along the line 3—3 of FIG. 1.
FIG. 4 is a fragmentary section, taken along the line 4—4 of FIG. 3.
FIG. 5 is a fragmentary side elevational view of the clamp device, mounted in operative position upon the track.
FIG. 6 is a fragmentary bottom plan view of the clamp device positioned upon a section of the track, in inoperative position.
FIG. 7 is a view of the clamp device taken from the opposite end, disclosed in FIG. 3.

Referring now to the drawings in more detail, FIG. 1 discloses a cloth spreading machine 10 including a frame, or machine frame, 11, supported by wheels, including grooved track wheel 12 mounted for movement along a track or rail 14 fixed alongside a cutting table 14 over which the spreading frame 11 moves reciprocally and longitudinally, in a conventional manner.

Mounted on top of the machine frame 11 is a cloth supply carriage, not shown, supporting a cloth supply roll, not shown, supplying a web of cloth 15 for ultimate spreading upon the cutting table 14. The cloth web 15 passes beneath a transverse guide bar 17, over a cloth feed roll 18 mounted on one end of the machine 10, and then down through an edge sensor 19 and through a conventional spreading unit 20. The spreading unit 20 spreads or lays the cloth web 15 upon the surface of the table 14 in layers 21, as the machine frame 11 reciprocates longitudinally on a predetermined course over the cutting table 14, from one of the spread layers to the other.

The machine frame 11 may be driven in any conventional manner, either by motor means, or manually, but the machine 10 disclosed in FIG. 1 is adapted to be driven by an electrical motor through known electrical controls, not shown.

Mounted at the lower front end portion of the frame 11, as illustrated in FIG. 1, is a front reversing switch or microswitch 23, which is electrically connected to the control circuitry for reversing the direction of movement of the electrical motor, not shown, and therefore the direction of movement of the machine frame 11. The front reversing switch 23 is adapted to be actuated by the front plunger 24 during its rearward movement relative to the reversing switch 23. The plunger 24 is reciprocally carried in the plunger bracket 25, and is biased by the spring 26 normally to its forward position.

In a similar manner, a rear reversing switch, not shown, but identical to the front reversing switch 23, may be mounted on the rear end portion of the frame 11 for reversing the direction of the machine 10 as it travels to the opposite or left end of the table 14 in FIG. 1.

When the machine 10 is moving forward, or toward the right in FIG. 1, and approaches the right end of its course, the plunger 24 engages a stop member or stop plate 28 forming a part of the clamp device 30 made in accordance with this invention. The engagement of the plunger 24 with the stop plate 28 causes the plunger 24 to stop as the machine 10 continues to move forward, producing a relative rearward movement of the plunger 24 and the front reversing switch 23, causing the plunger 24 to actuate the reversing switch 23. When the switch 23 is actuated, the direction of the electrical motor, not shown, is reversed, causing the machine 10 to stop, reverse its direction, and resume movement toward the rear or left of FIG. 1, in a well known manner.

As the machine 10 moves rearward, that is toward the left of FIG. 1, the plunger 24 moves relatively away from the switch 23, to de-actuate the front reversing switch 23.

The clamp device 30 made in accordance with this invention, includes a generally rectangular-shaped body member 31, upon the rear end of which is formed the transverse stop plate or stop member 28.

Formed on the inboard side portion of the body member 31 are a pair of elongaged parallel plates or bars, namely an elongated innermost fixed jaw plate 32 and spaced slightly inward therefrom an elongated straight guide flange or bar 33. The spacing between the jaw flange 32 and the guide flange 33 is slightly greater than the transverse thickness of the track 13, so that the jaw flange 32 and guide flange 33 may straddle the track 13 and be positioned on opposite sides of the track 13, in operative position. The space between the flanges 32 and 33 is completely open at the bottom and both ends, but the jaw flange 32 and the guide flange 33 are connected together across their top end portions by a top wall 34, constituting the top portion of the body member 31.

Formed within the body member 31 is an elongated cavity 35 which is closed along its top, bottom, front, and rear end portions, but is provided with an elongated outboard opening 36, and an inboard cleat opening 37 extending through a portion of the guide flange 33.

Pivotally mounted within the cavity 35 upon a vertical pivot pin 38 anchored in the body member 31, is a transversely extending cleat member 40. The operative end of the cleat member 40, including the operative or cleat face 41, projects through the cleat opening 37, so that the cleat face 41 may be moved through the cleat opening 37 reciprocally into and out of the space between the flanges 32 and 33, and to an operative position engaging the outboard face of the track 13, as disclosed in FIGS. 3, 4, and 7.

The opposite or actuator end portion of the cleat member 40 is coupled by a pivot pin 42 to the operative end portion 43 of an elongated lever handle 44. The actuator end portion of the cleat member 40 projects from the cavity 35 through the outboard opening or slot 36.

Pivotally connected to the lever handle 44 by a pivot pin 45, and spaced slightly forward of the pivot pin 42 on the arcuate-shaped operative end portion 43, is the free end portion of a locking bar 46. The abutment, pivotal, or front end portion 47 of the locking bar 46 is received within the body cavity 35 in abutting engagement with the abutment end of a threaded abutment screw 48, to permit locking bar 46 to pivot or swing about its abutment end portion 47.

The arcuate operative end portion 43 of the lever handle 44 is preferably curved in such a manner that the pivot pin 45 will lie transversely inboard from the pivot pin 42, when the lever handle 44 is in its clamped operative position, as disclosed in FIG. 2. When the lever handle 44 is pulled outboard to its inoperative position, as disclosed in FIG. 6, the pivot pin 45 will lie transversely slightly outboard of the pivot pin 42, in order to permit the lever handle 44 to swing through the dead center-line between the pivot pins 42 and 45 in order to produce the positive locking and unlocking positions for the lever handle 44.

The fixed jaw flange 32 is preferably provided with a plurality of set or stop screws 50 which may be adjustably inserted through the wall of the fixed jaw flange 32 to project into the space receiving the track 13, and to abut against the inboard face of the track 13 in operative position. The adjustment of the stop screws 50 is such that when the handle 44 is swung to its closed, clamped, or operative position, disclosed in FIGS. 2 and 4, the cleat face 41 will tightly engage the outboard surface of the track 13, while the inboard surface of the track 13 is firmly seated against the operative faces of the stop screws 50, as best disclosed in FIG. 4.

Projecting forward into the cavity 36 from the face plate 28 is a threaded stop screw 52, which is adapted to be engaged by the rear edge of the cleat member 40 when the lever handle 44 has been swung to its extreme inoperative position, as best disclosed in FIG. 6.

The quick-acting opertion of the clamp device is readily apparent from the above description. The device 30, with the lever handle 44 swung outboard to its inoperative, unclamping position, can be manually located, positioned, and clamped upon any section of the track 13, where it is desired to establish a stopping and reversing position for the cloth spreading machine 10, which in turn is determined by the length of the layers of cloth desired to be spread upon the cutting table 14. The flanges 32 and 33 are positioned above and on opposite sides of the track 13, and the body member 31 lowered with the fixed jaw flange 32 being disposed inboard or inside the track 13, while the guide flange 33 is disposed on the outside of the track 13. The body member 31 is lowered until the top wall 34 rests upon the top of the track 13, and the stop plate 28 is positioned transversely of the track 13 and in alignment with the switch plunger 24 of the cloth spreading machine 10.

The stop screws 50 may be adjusted, if desired, so that the operating faces of all of the stop screws 50 will engage the inboard face of the track 13.

The lever handle 44 is then swung inboard causing pivotal movement of the cleat member 40 and the locking bar 46 until the cleat face 41 firmly engages the outboard face of the track 13, and the pivot pin 45 moves through the dead center position of the pins 42 and 45 until the lever handle 44 is in its innermost position as disclosed in FIG. 2. In this operative, clamping or locking position of the lever handle 44 in FIG. 2, the pivot pin 45 is moved on the opposite side of its dead-center position from its unclamping position, disclosed in FIG. 6, to securely clamp and lock the cleat face 41 against the outboard surface of the track 13. The clamp device 30 will then remain in its clamped operative position until the lever handle 44 is positively swung outboard to its inoperative position, when it is desired to release or remove or transfer the clamp device 30 to another position.

The abutment screw 48 may be threadedly projected or retracted relative to the cavity 35 in order to vary the position of the locking bar 46 and thereby the cleat member 40, through the interconnection of the handle member 44, to change the degree of pressure exerted by the cleat face 41 upon the track 13, or to accommodate slightly varying widths or thicknesses of the track 13.

Once the cleat member 40 is clamped in locking operative position against the track 13, it cannot be forced away from this locking position, such as by vibrations of the machine 10 moving over the track 13, because of the over-dead center locking position of the locking bar 46.

As previously mentioned, it will be understood that other types of switch actuator elements, such as trip cams, magnets or reflective surfaces, may be substituted for the stop member 28 to cooperate with corresponding types of position-control switches carried by the cloth spreading machine 10.

What is claimed is:

1. A clamp device for selective positioning upon the longitudinal track of a cutting table for cooperation with a control switch actuator on a cloth spreading machine movable over the cutting table and longitudinally of the track, comprising:

(a) a body member having a switch actuator element, (b) said body member having an elongated jaw member adapted to engage one side of the track on a cutting table, in operative position, (c) a cleat member, (d) means mounting said cleat member on said body member opposing said jaw member for movement toward and away from said jaw member to engage the opposite side of the track from said jaw member in operative position and to disengage the track in an inoperative position, and (e) actuator means on said body member operatively connected to said cleat member for moving said cleat member between operative and inoperative positions for selectively clamping and unclamping said body member on the track of a cutting table, so that, in operative position, said switch actuator element is fixedly positioned for cooperation with a corresponding control switch actuator of a cloth spreading machine supported for movement on the track of the cutting table.

2. The invention according to claim 1 in which said mounting means comprises means pivotally mounting said cleat member on said body member.

3. The invention according to claim 1 in which said actuator means further comprises locking means for locking said cleat member in said operative position.

4. The invention according to claim 2 in which said actuator means comprises a lever handle pivotally connected to said cleat member, and means pivotally connecting said lever handle to said body member.

5. The invention according to claim 4 in which said cleat member comprises a cleat face opposing said jaw member and an actuator end portion on the opposite side of the pivotal axis of said cleat member from said cleat face, pivot means pivotally connecting said lever handle to said actuator end portion, a locking bar having first and second end portions, said first end portion being pivotally mounted in said body member at a remote position from said cleat member, and said second end portion being pivotally connected to said lever handle between said first end portion and said cleat member.

6. The invention according to claim 1 in which said jaw member comprises an elongated straight jaw flange fixed to said body member, and further comprising an elongated straight guide flange parallel to said jaw flange and spaced from said jaw flange a distance slightly greater than the width of the cutting table track to be engaged by said jaw member, said cleat member being movable transversely in the space between said guide flange and said jaw flange.

7. The invention according to claim 6 further comprising at least one transversely movable adjustable locking pin extending through said jaw flange for engaging the adjacent face of the track.

8. The invention according to claim 5 further comprising adjustment means for adjusting the position of the first end portion of said locking bar longitudinally of said body member.

* * * * *